United States Patent [19]

McMullen

[11] 4,047,651

[45] Sept. 13, 1977

[54] WATCH BAND

[76] Inventor: Richard Arnold McMullen, 2752 Choctaw Drive, Melbourne, Fla. 32935

[21] Appl. No.: 409,404

[22] Filed: Oct. 25, 1973

[51] Int. Cl.[2] ..... G04B 37/14

[52] U.S. Cl. ..... 224/4 D; 224/4 E; 2/338; 24/208 R

[58] Field of Search ..... 224/4.4 D, 4.5 E, 4.6 G, 224/28.8; 24/265 WS, 266 A, 208 A; 2/DIG. 6, 338

[56] References Cited

U.S. PATENT DOCUMENTS

| | | | |
|---|---|---|---|
| 1,508,940 | 9/1924 | Sedransky | 224/4 E |
| 1,674,835 | 6/1928 | Mix et al. | 224/4 D |
| 1,702,855 | 2/1929 | Swanson | 224/4 E |
| 2,104,560 | 1/1938 | Horowitz | 2/338 |
| 2,186,089 | 1/1940 | Baker | 224/4 D |
| 2,439,274 | 4/1948 | Spector | 224/4 E |
| 2,538,265 | 1/1951 | Paston | 224/4 D |
| 3,086,529 | 4/1963 | Munz et al. | 2/338 |
| 3,210,820 | 10/1965 | Hamiston | 24/208 A |
| 3,747,171 | 7/1973 | Montague | 224/4 E |
| 3,829,902 | 4/1974 | Fisher | 2/338 |

FOREIGN PATENT DOCUMENTS

| | | | |
|---|---|---|---|
| 545,897 | 10/1922 | France | 24/265 WS |
| 396,132 | 8/1933 | United Kingdom | 224/4 D |
| 970,698 | 9/1964 | United Kingdom | 2/DIG. 6 |

*Primary Examiner*—Robert B. Reeves
*Assistant Examiner*—H. Grant Skaggs
*Attorney, Agent, or Firm*—Dennison, Dennison, Meserole & Pollack

[57] ABSTRACT

A fabric watch band formed of an elongated fabric strap or webbing having the full length opposed longitudinal edges enclosed within edge binding. The opposite ends of the bound strap are reversely bent and secured to the main portion of the strap and overlaid by complementary components of a pressure attachable material such as VELCRO. Watch mounting loops are fixed to the main body portion of the strap, either permanently as by stitching or releasably through interengaging snap fasteners.

3 Claims, 7 Drawing Figures

Fig. 1
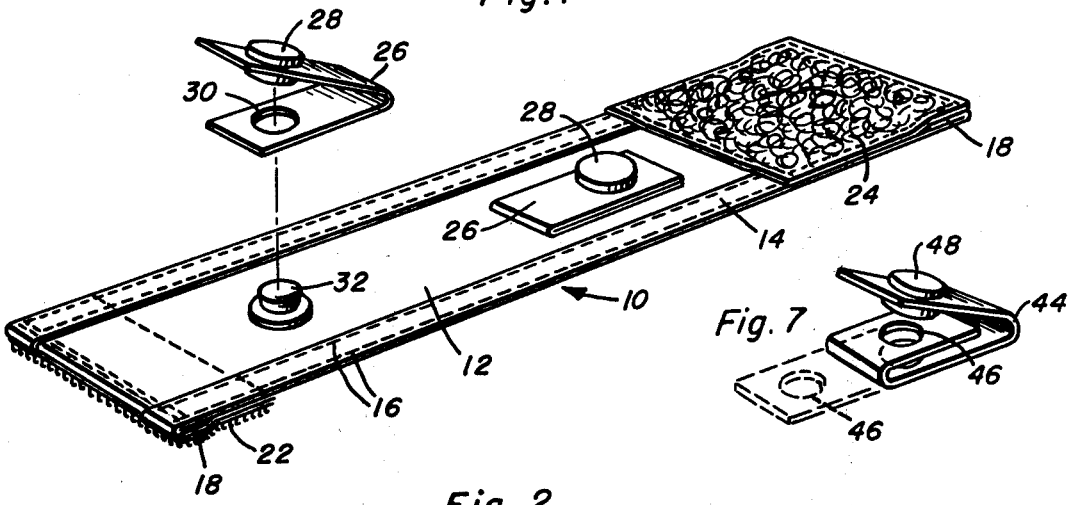
Fig. 7
Fig. 2
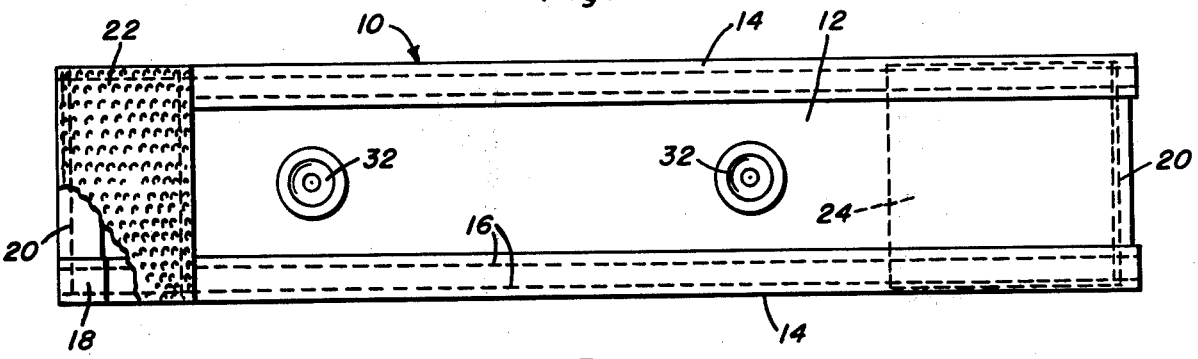
Fig. 3
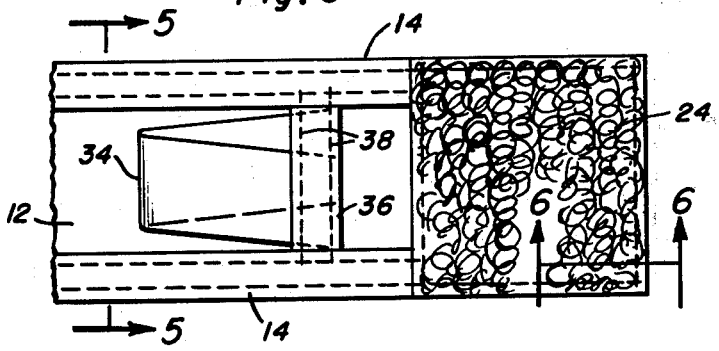
Fig. 4
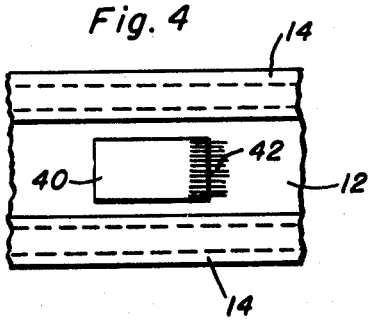
Fig. 5
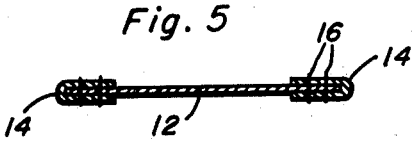
Fig. 6
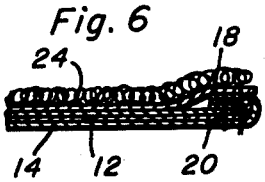

WATCH BAND

The present invention generally relates to watch bands and is more specifically concerned with a fabric watch band construction of a highly durable, attractive and functional nature.

Basically, what is proposed herein is a watch band construction utilizing, as the preferred material for substantially all of the elements thereof, nylon. Structurally, the watch band is to be formed of an elongated nylon strap or webbing having the full length opposed longitudinal edges thereof enclosed and securely bound by edge binding, also preferably nylon, stitched thereto. The opposed ends of the strap are finished by merely oppositely bending these ends, along with the side bound portions thereof, and stitching the turned ends to the main portion of the strap or webbing. In this manner, smooth ends are automatically provided without requiring separate binding thereon. A pair of hook and loop pressure attachable fabric components are then stitched in overlying relation to the two reversely turned end portions in a manner so as to directly cooperate with each other upon a mounting of the band on the wrist. The fastener components provide, within the range thereof, for infinite adjustment of the band. The actual mounting of the watch on the band is effected through a pair of opposed loops appropriately secured by any of three methods including a direct stitching of the open ends of the loops to the webbing, the use of a loop end overlying binding strip sewn to the webbing with the loop ends secured therebetween, or a unique snap fastener arrangement allowing for an interchanging of the loops as desired.

With regard to the snap fastener mounting of the loops, such is deemed particularly unique in that each loop utilizes only a single fastener to provide for both a selective opening and closing of the two ends of the loop so as to allow for the mounting of the watch and a mounting of the loop itself to the strap or webbing.

The band, formed in the manner described, is provided with smoothly finished protected edges and end portions completely thereabout in a simple and economical manner enabling one to take full advantage of a readily available inexpensive and desirable material such as nylon for a product of the type contemplated herein.

Other objects, advantages and features of the invention will become more fully apparent from a consideration of the detailed description which follows when taken in conjunction with the accompanying drawings wherein:

FIG. 1 is a perspective view of the watch band of the invention with one of the watch mounting loops exploded therefrom for purposes of illustration;

FIG. 2 is a bottom plan view of the band of FIG. 1 with a portion broken away for purposes of illustration;

FIG. 3 is a top plan view of one end portion of a similar band with a variation in the manner of mounting a watch retaining loop;

FIG. 4 is a partial top plan view illustrating a further variation in the manner of mounting the watch retaining loops;

FIG. 5 is a transverse cross sectional view through the basic band taken substantially on a plane passing along line 5—5 in FIG. 3; and FIG. 6 is an enlarged cross sectional detail taken substantially on a plane passing along line 6—6 in FIG. 3 and illustrating the end construction of the band.

FIG. 7 shows a variation of the loop of FIG. 1 in which two spaced apertures are formed at one end portion of the loop which carries a snap fastener component at the other end thereof.

Referring now more specifically to the drawings, reference numeral 10 is used to generally designate the watch band comprising the invention. This band 10 includes an elongated fabric strap or webbing 12, preferably formed of a lightweight closely woven nylon, having the opposed full length longitudinal edges thereof enclosed by nylon binding 14 which is stitched to the webbing 12 by a spaced double row of stitches 16. As will be appreciated, the webbing 12 can be of any desired width with the colors of the webbing 12 and binding 14 being the same or different in accordance with the appearance desired.

The opposed ends of the bound strap or webbing 12 are finished by reversely bending these ends in opposite directions so as to closely overlie the main body of the strapping after which the reversed ends, designated by reference numeral 18, are stitched into position by single transverse rows of stitching 20. Formed in this manner, it will be appreciated that the edge of the watch band 10, completely about the periphery thereof, is finished and smooth with there being no exposed loose threads or the like such as might ultimately tear or cause an unraveling of the fabric. The unique manner of reversely turning the opposed ends 18 of the edge bound strap 12 eliminates the necessity of providing separate binding therealong.

The mounting of the watch band 10 about the wrist of a wearer is effected through the use of mating components of a pressure attachable material such as the nylon tape fastener disclosed in U.S. Pat. No. 2,717,437 wherein one component or piece of nylon tape is covered with finely woven filaments formed into permanent hooks and the other nylon piece or component is covered with soft nylon loops. When pressed together the two tapes engage and fasten tightly to form a strong shear resistant bond which can, at the same time, be readily peeled apart. One example of such material is VELCRO.

In mounting these components on the band of the invention herein, the hook component 22 is laid over one reversely bent end 18 and the adjoining end portion of the edge bound strap 12 with the other component, the loop component 24 laid over the other reversely bent end 18 and the adjoining strap portion with both components being stitched, peripherally thereabout, directly to the underlying strap.

As will be appreciated from the drawings, one pressure attachable component overlies one face of the strap while the other component overlies the opposed face of the strap whereby a mating of these components will be effected upon a positioning of the band about the wrist of a wearer. Also, in stitching each of the components 22 and 24 to the underlying strap portion, it will be noted that the stitching, in addition to mounting the pressure attachable components, also additionally peripherally secures the reversely bent ends 18, thus providing for a dual function for the component mounting stitching. As illustrated, the components 22 and 24, in addition to extending the full width of the band 10, extend an approximately equal distance along the length of the band. In this manner, a substantial range of adjustment is provided for with the adjustment of the band, within the limits defined by the lengths of the components 22 and 24, being infinite.

It is contemplated that a pair of opposed loops 26 be used to mount a watch on the main body portion of the strap or webbing 12. Noting FIGS. 1 and 2 in particular, the loop 26 is formed of a length of nylon tape mounting one component 28 of a snap fastener on one end thereof and having an enlarged aperture 30 through the second end portion thereof. The second component 32 of the snap fastener is permanently affixed to the strap or webbing 12 with a mounting of the loop 26 involving a positioning of the aperture 30 over the strap component 32 whereby the component 32 projects therethrough for engagement by the loop component 28. In this manner, utilizing a single snap fastener, the loop 26 is both closed and mounted on the strap body.

Formed in this manner, it will be appreciated that the loops 26 can easily be interchanged or replaced, allowing the use of differently colored loop sets as desired. Further, the watch itself can be easily mounted and removed, either with or without a removal of the loops 26 by merely unsnapping the components 28 and 32. Each loop itself is of extremely simple construction, requiring only a single strip of nylon tape apertured at one end and mounting a snap fastener component at the second end.

Noting FIG. 3, the loop 34 therein has been illustrated as being permanently affixed to the strap 12 by stitching the two free end portions thereof between an overlying transverse strip of binding 36 and the strap 12. It also will be noted that the loop 34 has the end portions thereof laterally spread from each other to prevent a wider appearance and a broader engagement with the watch mounting pin. It will be noted that the binding 36 and underlying end portions of the loop 34 are secured by a double row of stitching 38.

Another manner of permanently affixing the watch mounting loops is illustrated in conjunction with loop 40 in FIG. 4. In this arrangement, the free end portions of the loop 40 are directly overlapped and stitched, by an appropriate zig-zag stitching or the like 42, directly to the strap 12 between the two side bindings 14. The fixed loops of both FIG. 3 and FIG. 4 are also preferably formed of nylon so as to conform to the remainder of the watch band and provide an economical, easily cleaned and long lasting item.

A further means of attaching the loops, illustrated in FIG. 7, is a variation of the means of FIG. 1. In this variation, the tape which forms the loop 44 is of greater length and includes two spaced apertures 46 through one end portion in addition to a snap fastener component 48 mounted on the second end thereof. The loop 44 is mounted by folding the one end portion of the tape to align the apertures 46 and then positioning both apertures over the strap component 32 and engaging the loop component 48 with the strap component 32. In this manner a stronger loop mounting is provided while still retaining all of the advantages of the form of FIG. 1.

While nylon has been set forth as the preferred material, it should be appreciated that other synthetic fabrics, for example Orlon and Krylon, can also be used.

The foregoing is illustrative of the principles of the invention. Further, it will be apparent to those skilled in the art that changes and modifications may be made. As such, it is not desired to limit the invention to the exact construction and operation shown and described, and accordingly, suitable modifications may be made without departing from the spirit and scope of this invention.

What is claimed is:

1. A fabric watch band comprising an elongated fabric strap having upper and lower sides, opposed longitudinal edges and first and second end portions, said first and second portions of the strap being reversely bent on the strap to the opposite sides thereof to form finished end edges, a pair of complementary pressure attachable components positioned to the opposite sides of said strap in overlying and concealing relation to the reversely bent end portions, and stitching securing each component and underlying reversely bent end portion to the strap, said pressure attachable components being formed of a fabric-like material incorporating releasably engageable hook-like elements on one component and loop-like elements on the second component and watch mounting means fixed to one side of the strap, said watch mounting means comprising a pair of loops, each loop comprising a length of material having the opposed ends positioned in generally overlying relation to each other, and means fixing the loop ends to the strap, said means fixing the loop ends to the strap comprising a pair of complementary fastener components, one fastener component being fixed to the strap and the second fastener component being fixed to one end of the loop, the second end of the loop having an aperture therethrough freely positionable in overlying relation to the strap about the strap mounted fastener component whereby the two fastener components can be interlocked with the apertured end of the loop trapped therebetween for a combined removable mounting of the loop on the strap and a closing of the loop for the retention of a watch.

2. A watch band comprising a elongated flexible strap, said strap having first and second ends mounting complementary fastener components selectively interlockable with each other, and watch mounting means fixed to said strap between the ends thereof, said watch mounting means comprising a pair of loops, each loop comprising a length of material having the opposed ends thereof positioned in generally overlying relation to each other, a pair of complementary snap fastener components associated with each loop, one of said components being fixed to the strap, the second of said components being fixed to one end of the length of material comprising the loop, the second end of the length of the material having an aperture therethrough freely positionable in overlying relation to the strap about the strap mounted component for a selective removal therefrom, a second aperture through the length of material, positioned along the length of the loop material between the first aperture and the snap fastener component fixed to the loop material, alignable with the first aperture upon a folding of said material, said components being interlockable through both apertures for a releasable retention of the apertured end of the length of material in conjunction with a fixing of the component mounting end of the length of material.

3. A self-mounting replaceable watch retaining loop member comprising an elongated length of flexible material having a single snap fastener component fixed thereto for cooperative releasable engagement with a complementary snap fastener component on a separate wrist encircling strap, said loop member further including an aperture defined therethrough in longitudinal alignment with the member component and sufficiently spaced therefrom to, upon a folding of the member, align with the member component and define a closed loop to one side thereof upon an engagement of the member component with the strap component through the aperture, said loop member further including a second aperture defined through the length of material and being positioned along the length of the loop member between the first aperture and the snap fastener component fixed to the loop member, said second aperture being alignable with the first aperture upon a folding of the material so as to enable a releasable engagement of the member component with the strap component through both apertures.

* * * * *